US007748419B2

(12) United States Patent
Fink, Jr. et al.

(10) Patent No.: US 7,748,419 B2
(45) Date of Patent: Jul. 6, 2010

(54) DRIPLESS MEANS FOR A FUEL DISPENSING NOZZLE

(75) Inventors: Arthur C. Fink, Jr., Londell, MO (US); Jeffrey M. Deaton, St. Louis, MO (US); Mark P. Vilmer, Florrisant, MO (US); Thomas O. Mitchell, Maryland Heights, MO (US); Darrell P. Vilmer, St. Louis, MO (US); Richard D. Benscoter, Union, MO (US)

(73) Assignee: Husky Corporation, Pacific, MO (US)

( * ) Notice: Subject to any disclaimer, the term of this patent is extended or adjusted under 35 U.S.C. 154(b) by 1070 days.

(21) Appl. No.: 11/443,960

(22) Filed: May 31, 2006

(65) Prior Publication Data

US 2006/0272733 A1 Dec. 7, 2006

Related U.S. Application Data

(60) Provisional application No. 60/688,199, filed on Jun. 7, 2005.

(51) Int. Cl.
*B65B 1/04* (2006.01)

(52) U.S. Cl. ..... 141/311 A; 222/108; 222/479; 222/571; 141/116; 141/302; 141/308; 141/392; 141/59

(58) Field of Classification Search ..... 141/59, 141/115, 116, 206, 285, 290, 301, 302, 308, 141/363, 382, 387, 389, 392; 222/108, 478, 222/479, 571
See application file for complete search history.

(56) References Cited

U.S. PATENT DOCUMENTS

| | | | | |
|---|---|---|---|---|
| 2,087,139 | A * | 7/1937 | Cameron | 361/215 |
| 4,113,153 | A * | 9/1978 | Wellman | 222/571 |
| 5,127,451 | A | 7/1992 | Fink et al. | |
| 5,522,440 | A * | 6/1996 | Mitchell | 141/392 |
| 5,562,133 | A * | 10/1996 | Mitchell | 141/206 |
| 7,063,112 | B2 * | 6/2006 | Fink et al. | 141/311 A |

* cited by examiner

*Primary Examiner*—Gregory L Huson
*Assistant Examiner*—Jason K Niesz
(74) *Attorney, Agent, or Firm*—Paul M. Denk

(57) ABSTRACT

A dripless means for a fuel dispensing nozzle begins with a nozzle for dispensing fuel into automobile tanks. Regulations limit drainage of the spout to within ten seconds, met by the present invention that prevents fuel drops from exiting the spout. First, the spout retains fuel drops behind a dam made of a series of fins upon the interior of the spout. Second, the present invention has a bushing with a weir that works in combination with the damming. Third, the nozzle has a vent tube within the spout where a plug constricts its diameter to limit the fuel drawn into the vent tube. With proper use, the present invention retains fuel drops in the spout to meet the regulations.

13 Claims, 3 Drawing Sheets

DRIPLESS MEANS FOR A FUEL DISPENSING NOZZLE

CROSS REFERENCE TO RELATED APPLICATION

This nonprovisional patent application claims priority to the provisional patent application having Ser. No. 60/688,199, which was filed on Jun. 7, 2005.

BACKGROUND OF THE INVENTION

The dripless means for a fuel dispensing nozzle relates to nozzles used to dispense gasoline into automobile fuel tanks, in general, and more specifically to improvements in the spout, the vent tube and the bushing to reduce the number of drips from the spout after fueling. Unique aspects of the present dripless means are grooves applied to the interior surface of the spout, a bushing with arc weirs, and a restrictor in the vent tube.

As is well known in the art, and to the public, gasoline-dispensing nozzles of the type used in most service stations have a spout which is inserted into the inlet of the filler pipe of an automobile fuel tank. The diameter of the spout is less than that of the filler pipe resulting in a gap between the side of the spout and the filler pipe. Consequently, gasoline vapors leaked into the atmosphere. Escaping gasoline vapors raise pollution concerns and have triggered government regulations of fuel dispensing nozzles. Regulations require such nozzles to reduce the pollutants released to the atmosphere. A flexible bellows assembly fitted over the spout is one way of meeting the regulations, usually called the balanced pressure nozzle.

However, the regulations further address drops of fuel that exit the spout after fueling. A user releases a lever to stop fuel flow into the nozzle. Some fuel remains within the nozzle and the spout. Under gravity, the fuel exits the spout as drops and evaporates. The California Air Resources Board is strict to the extent that it limits nozzles to no more than three drops emitted from a spout after fueling. A further test by the Board requires draining of the spout within ten seconds when oriented at a thirty degree angle in the vehicle fill opening, commonly called the Post Fueling Drip Test.

Prior art designs provided valves at the end of the spout to block drops. Though stopping the fuel drops, such valves added to the weight and cost of a nozzle. These prior art valves tended to corrode and to malfunction after substantial usage. Along with wearing of valves, tipping of nozzles to the side may release upwards of six drops of fuel from the spout.

The present invention overcomes the limitations of the prior art. That is, in the art of the present invention, a dripless means, prevents the fuel dripping from the spout without a valve.

The difficulty in providing a dripless means is shown by the operation of a typical nozzle. A user completes fueling and releases a lever on a nozzle. The nozzle retains some fuel in the spout and internal parts of the nozzle, such fuel that has not dispensed into an automobile's fuel tank. As the user replaces the nozzle at the pump, fuel follows gravity towards the distal end of the spout. The fuel encounters a valve that closes automatically upon release of the lever. Fuel becomes drops beyond the valve. As the valve wears, more fuel escapes and generates drops.

The use of nozzles to dispense fuel is known in the prior art. For example, the U.S. Pat. No. 5,127,451 to Fink and Mitchell discloses a fuel dispensing nozzle improvement of a bellows to trap fuel vapors during filling of a tank. The bellows surrounds the spout for its full length and captures vapors. However, upon nozzle shutoff, such fuel remains in the spout by capillary action or otherwise. The undisclosed surface of the spout permits fuel to exit the spout as drops. Thus, the prior art type of devices do not provide for reducing the number of fuel drops leaving a nozzle.

SUMMARY OF THE INVENTION

A dripless means for a fuel dispensing nozzle begins with a nozzle for dispensing fuel into automobile tanks and the like. The nozzle controls fuel delivery with a manual lever and valve within a housing. Opposite the housing, the spout dispenses fuel when the lever is grasped, and at fuel shutoff when the lever is released some residual fuel remains within the spout. Further, the sudden shutoff of the nozzle causes a negative vacuum in the spout causing fuel to rebound inside the spout due to the inertia of the fuel flow. Regulations as previously stated limit the drops to three or less in number after drainage of the spout for ten seconds in the vehicle. Fully draining the spout in that short time interval has proven difficult. Forcing the fuel from the spout, by pressurized air for example, has failed to meet the Board requirements. Capillary and wetting action retains fluids on the interior surface of the spout, raising the risk of fuel drops later escaping from the spout.

The present invention meets the Board requirements by preventing fuel drops from exiting the spout. First, the spout retains residual fuel generally behind a dam formed as a series of fins within the spout. The residual fuel is dammed by hydraulics and retained by the fins formed by grooves. Hydraulic damming retains approximately twelve drops within the spout in approximately five seconds after shutoff. Rotating the nozzle to make the spout vertical, tests have shown that the spout has fewer drops exiting.

Secondly, the present invention has a bushing with reservoir properties. Located proximate to the tip of the spout, the bushing retains residual fuel behind arc weirs. The arc weirs extend partially along the circumference of the bushing and partially into the bushing. The bushing reservoir also retards drop formation and works in combination with the hydraulic damming.

Thirdly, the nozzle has a vent tube centered within the spout. The vent tube extends from the tip back to the housing. At shutoff though, a vacuum arises in the vent tube and may indirectly draw liquid fuel into the vent tube. A restrictor in the vent tube constricts the diameter of the tube to limit the fuel drawn into the vent tube.

With proper use, the present invention retards dripping from the spout following shutoff to meet the Board requirements. When returned to the pump, the present invention retains residual gasoline within the spout until it enters the tank of the next fueling vehicle. Motorists and station attendants must use the present invention properly for stations to adhere to Board requirements.

BRIEF DESCRIPTION OF THE DRAWINGS

The same reference numerals refer to the same parts throughout the various figures.

DESCRIPTION OF THE PREFERRED EMBODIMENT

Figure 1:
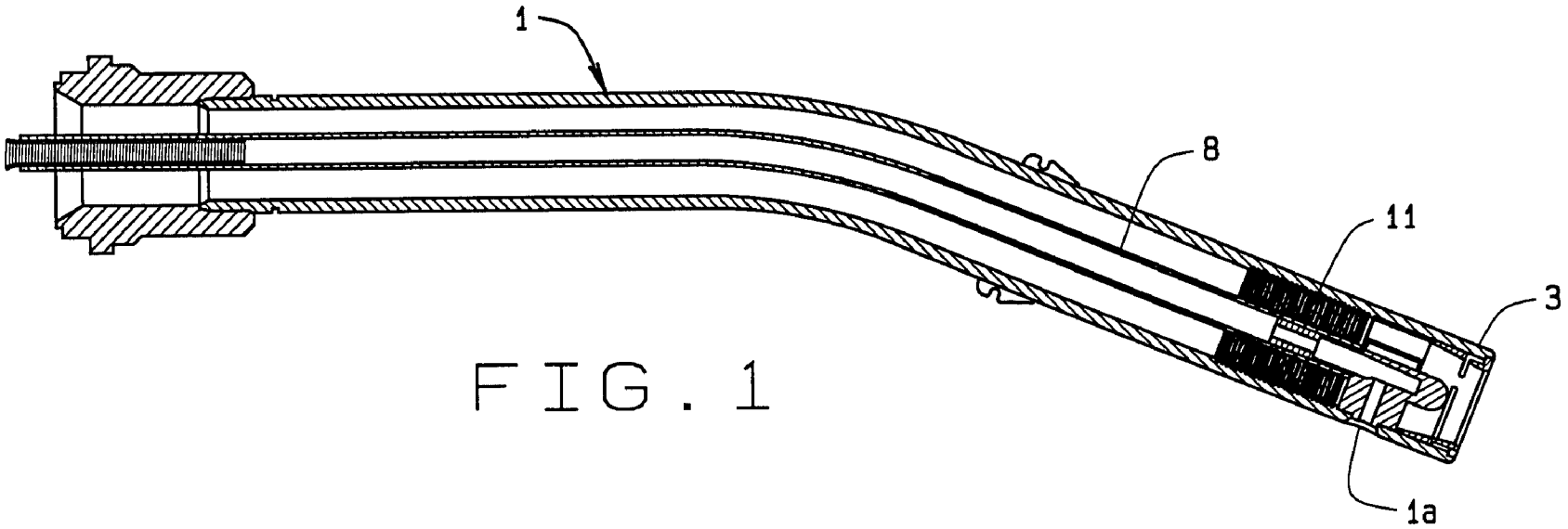
FIG. 1 shows a sectional view of the preferred embodiment of the dripless means for a fuel dispensing nozzle constructed in accordance with the principles of the present invention.

The present art overcomes the prior art limitations by providing a restriction to the vent tube, fins/grooves within a portion of the spout, and a bushing with arc weirs to retain fuel. Referring to FIG. 1, the preferred embodiment of the dripless means for a fuel dispensing nozzle is shown generally as the right half of a nozzle spout. The spout 1 has a rounded hollow tubular form with a cant towards the distal end 3 of the spout 1. When assembled ahead of a handle (not shown), the spout 1 delivers fuel through the distal end 3. Centered within the spout 1 and connecting to the handle, a vent tube 8 connected to the sensing port 1*a* transmits the presence of fuel at the port to the nozzle automatic shut off.

Figure 2:
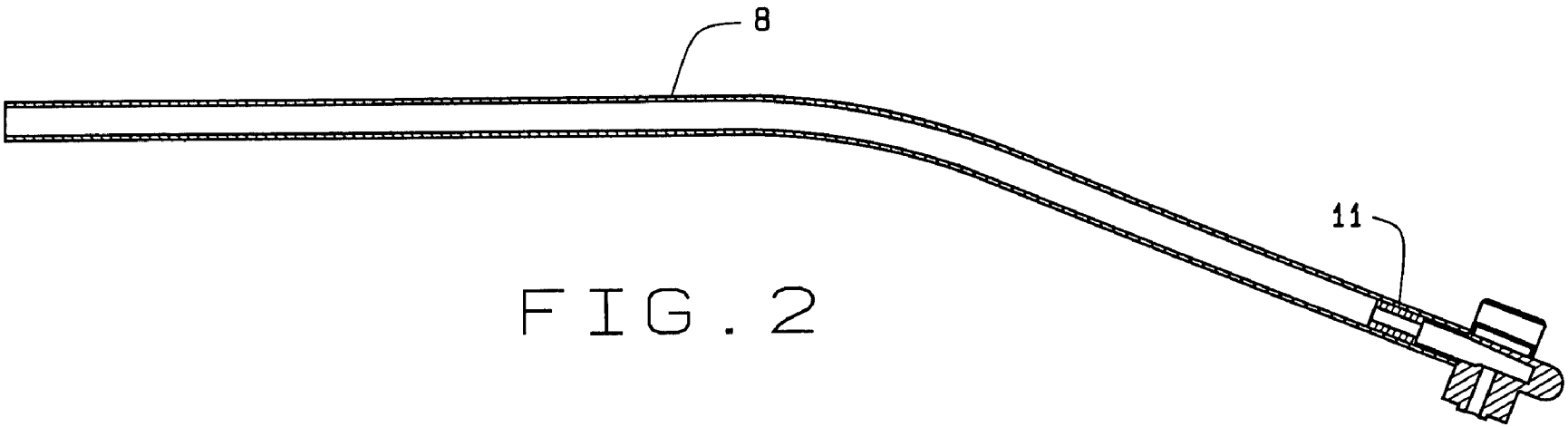
FIG. 2 shows a sectional view of the vent tube with a tip restrictor of the preferred embodiment of the present invention.

Viewing FIG. 2, the vent tube 8 is a generally round cylindrical tube of a length similar to the spout 1. The vent tube 8 has a cant to match the spout 1 as well. Distally, the vent tube 8 has a tip end of a generally cylindrical shape and of a diameter greater than the vent tube 8. The tip end has a centered minor tube that extends radially outward. The minor tube aligns with a vent hole 1*a* in the spout 1. Centered in the tip end, a major tube extends perpendicular to the tip end and into the vent tube 8. The major tube has a diameter slightly smaller than the vent tube 8 and fits snugly within it. Upon the major tube and opposite the tip end, a restrictor 11 fits within the vent tube 8. The restrictor 11 has a generally cylindrical shape with an outer diameter slightly smaller than the vent tube 8 and an inner diameter at least one fifth the diameter of the vent tube 8. The restrictor 11 fits snugly within the vent tube 8 and firmly upon the major tube. The restrictor 11 has a length of at least two vent tube 8 diameters.

At shutoff, the lever opens and fuel ceases flowing into the spout 1. Once the fuel departs the spout 1, a vacuum arises in the spout 1 and the vent tube 8. The tip end admits vapors and residual fuel into the vent tube 8. Residual fuel in liquid form may clog or impede the vent tube 8. The restrictor 11 narrows the effective diameter of the vent tube 8 to impede liquid fuel from proceeding further up the vent tube 8 while admitting vapors readily into the remainder of the vent tube 8.

Figure 3:
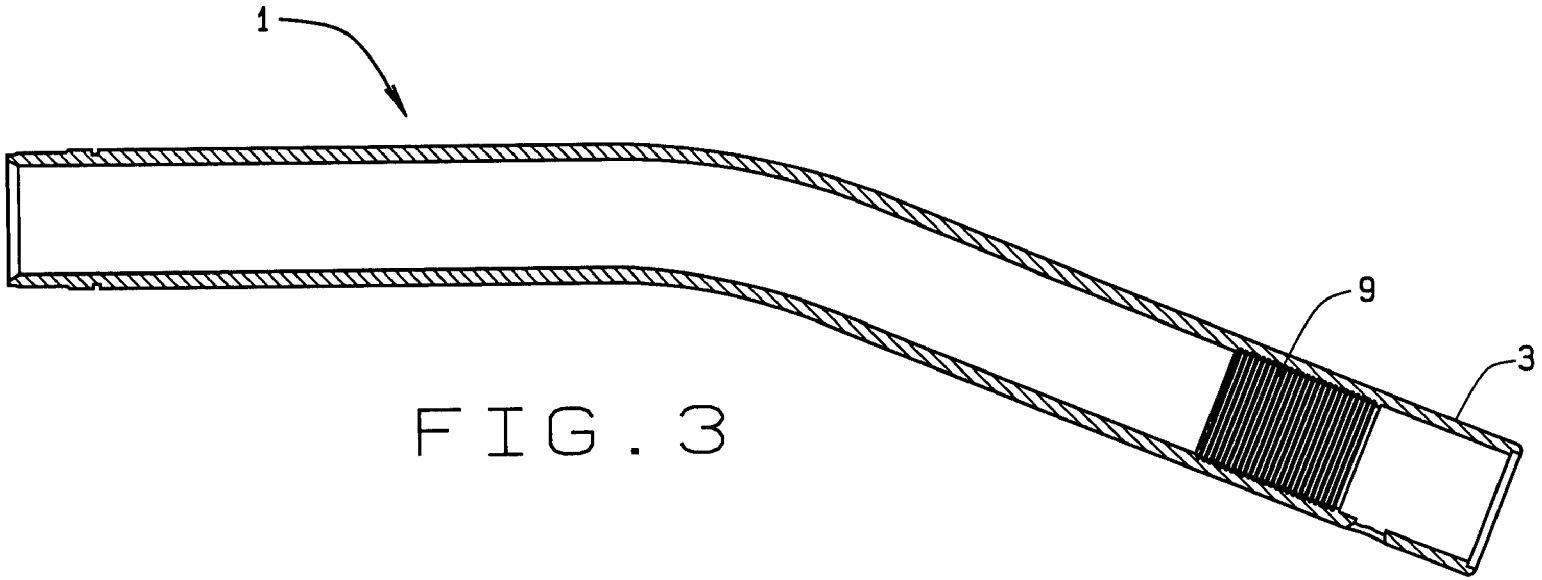
FIG. 3 shows a sectional view of the spout with fins/grooves of the preferred embodiment.
Figure 4:
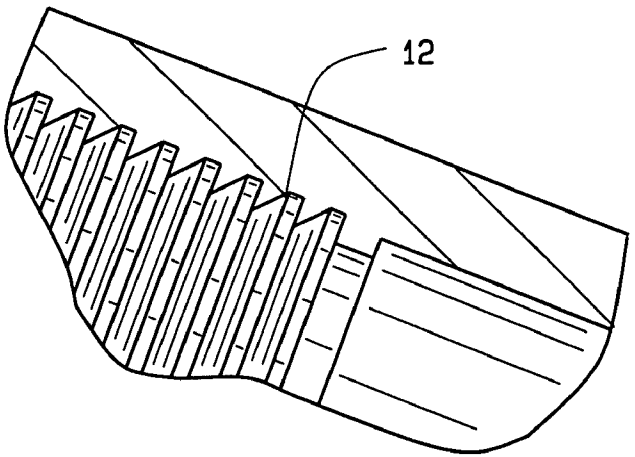
FIG. 4 illustrates a detailed view of the fins/grooves of the present invention.

Turning to FIG. 3, the spout 1 has a generally hollow round cylindrical form with a cant to bring the distal end 3 beneath the proximal end. The spout 1 has an interior surface upon which fuel passes during delivery. The interior surface extends the length of the spout 1 and the inside diameter of the spout 1. Proximate to the distal end 3, the spout 1 has a vent hole 1*a* that connects with the tip end. The interior surface has a surface treatment 9 to impede fuel. In the preferred embodiment, the surface treatment 9 includes a plurality of fins/grooves 12 stacked upon the inner diameter of the spout 1. The fins/grooves 12 occupy the circumference of the spout 1 and have a tip towards the center of the spout 1. The tip is positioned towards the proximal end 3 of the spout 1 and the base is positioned towards the distal end of the spout 1. The fins 12 are spaced in a regular pattern that extends a length of at least one spout 1 diameter. The base is located within the wall and the tip has a diameter similar to the inner diameter of the spout 1 without the fins 12 as shown more clearly in FIG. 4.

Again at shutoff, fuel remains in the spout 1 and drains towards the distal end 3 of the spout 1. Encountering the fins/grooves 12, with the spout angled down at 30 degrees very little fuel remains in the fins 12 due to hydraulic damming and capillary action. The fins/grooves 12 can capture upwards of twelve droplets of fuel while returning the nozzle to the dispenser.

Figure 5:
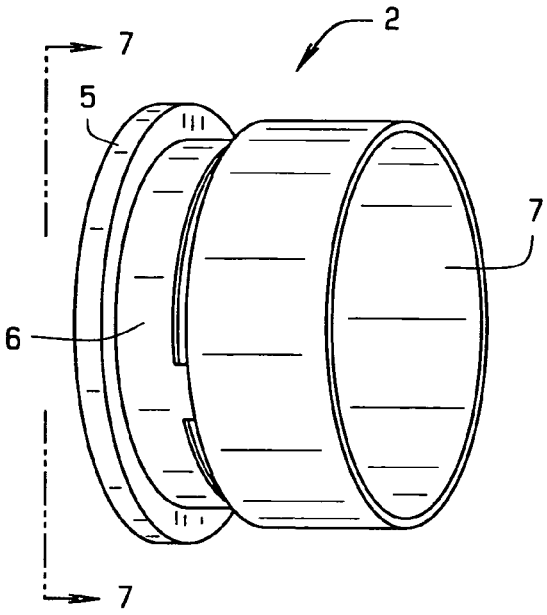
FIG. 5 shows a perspective view of a bushing of the preferred embodiment of the present invention.

Turning to FIG. 5, the bushing 2 installs ahead of the tip end within the spout 1 at the distal end 3. Overall, the bushing 2 has a generally round hollow cylindrical shape. The bushing 2 has a front 4 and an opposite rear 7 with the front 4 denoting a plane perpendicular to the longitudinal axis of the bushing 2 and installed at the distal end 3 of the spout 1. The front 4 has a lip 5 with a diameter that sets the outer diameter of the bushing 2. The lip 5 has a length less than one tenth the length of the bushing 2. Behind the lip 5 is a step 6, the step 6 has an outer diameter less than that of the lip 5 and the rear 7. The step 6 has a length at least one fifth the length of the bushing 2. Behind the step 6 is the rear 7 that has an outer diameter more than the step 6 but less than the lip 5. The rear 7 has at least one third the length of the bushing 2.

Figure 6:
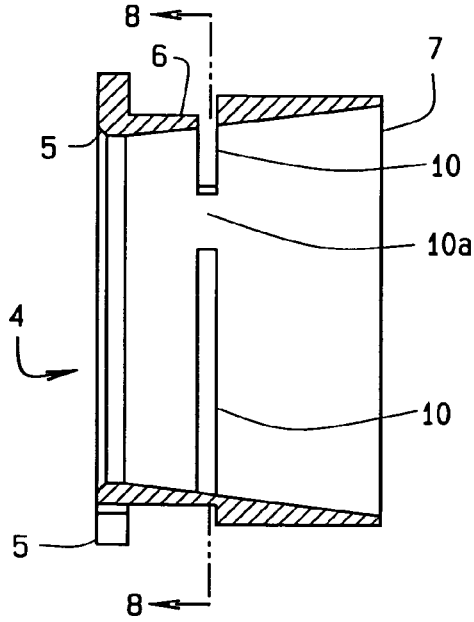
FIG. 6 shows a longitudinal sectional view through the bushing of the present invention.

Then in FIG. 6, the bushing 2 has a hollow center shaped like a truncated cone, here shown as a trapezoidal section 10. The hollow center passes through the lip 5, the step 6, and the rear 7. The bushing 2 has an inner diameter at the rear 7 that tapers to a lesser diameter at the lip 5.

The bushing 2 has a front 4 with a lip 5. The lip 5 has an inner diameter less than the inner diameter of the rear 7. The outer diameter of the lip 5 establishes the outer diameter of the bushing 2. The lip 5 has a thin thickness along the length of the bushing 2. Behind the lip 5, the bushing 2 has a step 6 that interlocks with the distal end 3 of the spout 1 to secure the bushing 2, tip end, and vent tube 8 within the spout 1. The step 6 has a lesser diameter than the lip 5 and the rear 7. Within the step 6 behind the lip 5 towards the rear 7, the bushing 2 retains residual fuel after shutoff behind a hydraulic dam, or arc weir 10. Where the step 6 joins the rear 7 upon the interior, the bushing 2 has three arc weirs 10 forming a partial ring. Each arc weir 10 ends in a web 10*a* so that each arc weir 10 with a web 10*a* occupies approximately 120° of the inside circumference of the bushing 2 and the arc weirs 10 are regularly spaced.

Figure 7:
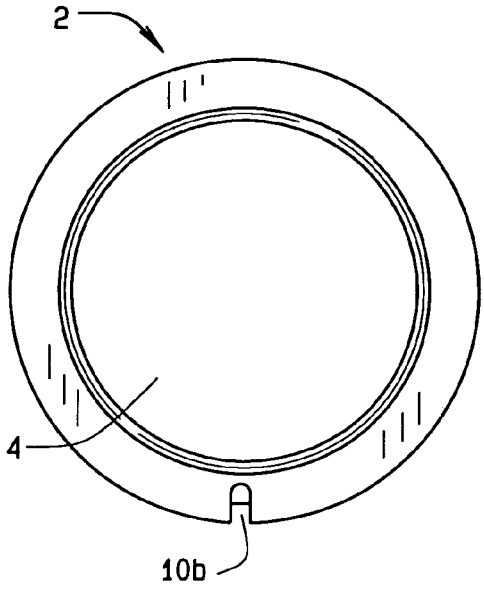
FIG. 7 shows a front view of the bushing of the present invention.

Moving to FIG. 7, the lip 5 of the bushing 2 has a generally round shape with an inner diameter and a radial notch 10*b*. The inner diameter allows passage of fuel from the spout 1 into a tank. The inner diameter is the narrowest diameter of the hollow center of the bushing 2. The hollow center expands in diameter from the lip 5 towards the rear 7. The notch 10*b* extends partially through the lip 5 from the outer edge along a radial line. The notch 10*b* denotes the bottom of the bushing 2.

Figure 8:
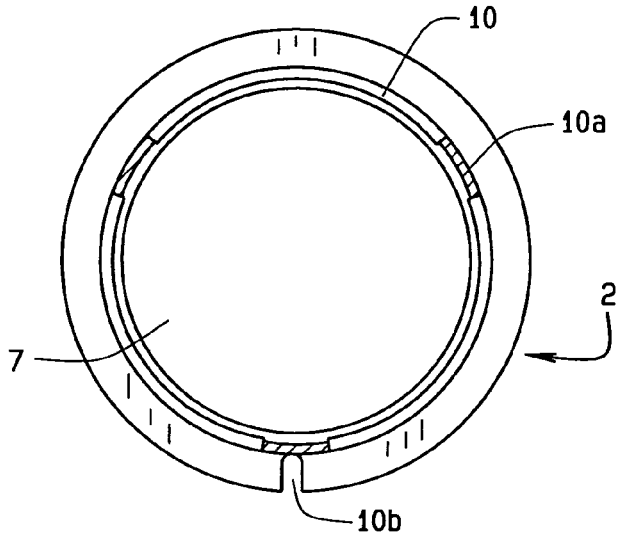
FIG. 8 shows a sectional view laterally through the bushing of the preferred embodiment of the present invention.

Moving to FIG. 8, behind the lip 5 and where the step 6 joins the rear 7, the bushing 2 partially retains residual fuel drops after shutoff behind a hydraulic dam, or arc weirs 10. The arc weirs 10 form an intermittent ring made of three arc weirs 10, equally spaced. Each arc weir 10 ends in a web 10*a* so that each arc weir 10 occupies approximately one third of the inside circumference of the bushing 2 in regular spacing. One web 10*a* is collocated with the notch 10*b* and the other two webs 10*a* flank the notch 10*b* symmetrically.

To utilize the present art, the three features, fins 12, bushing 2, and tip restrictor 11, work together to prevent drips. The fins 12 are incised or raised from the interior surface of the spout 1, the bushing 2 is machined to include three arc weirs 10 with adjacent webs 10*a*, and the tip restrictor 11 is placed within the vent tube 8. The bushing 2 is at the distal end 3 of the spout 1. After shutoff by the nozzle, fuel drops impound behind the arc weirs 10 of the bushing 2, adhere to the fins 12, and shrink ahead of the tip restrictor 11. In co-action, the fins 12, the arc weirs 10, and the tip restrictor 11 combine to reduce the number of drips from the spout to less then 3.

From the aforementioned description, a dripless means has been described. The dripless means is uniquely capable of capturing fuel within a spout to prevent drops from exiting the spout and evaporating. The dripless means and its various components may be manufactured from many materials including but not limited to steel, polymers, high density polyethylene HDPE, polypropylene PP, polyvinyl chloride PVC, nylon, ferrous and non-ferrous metals, their alloys, and composites.

We claim:

1. A nozzle for dispensing fuel into a vehicle tank has a spout; a bushing at the distal end of said spout said bushing having a generally cylindrical shape with a front having a lip, a step of lesser diameter than said lip, a rear of similar diameter to said front, and a hollow center there through; and, a cylindrical vent tube within said spout, wherein the improvement comprises:

said spout having a surface treatment upon a portion of the interior of said spout;

said bushing having one or more arc weirs upon the interior of said bushing; and, said vent tube having a tip restrictor installed therein;

whereby, said surface treatment, and said sections, and cooperate to retain fuel drops within said nozzle.

2. The nozzle of claim 1 further comprising:

said surface treatment having a plurality of fins, said fins being concentric and extending for the complete circumference of the interior surface of said spout;

said arc weirs extending into the interior of said bushing; and, said tip restrictor having a generally hollow cylindrical shape to fit snugly within said vent tube.

3. The nozzle of claim 2 wherein said tip restrictor has an inner diameter less than one half the diameter of said vent tube.

4. The nozzle of claim 2 wherein said arc weirs extend less than five per cent of the outside diameter of said bushing and into said bushing.

5. The nozzle of claim 4 further comprising:

three arc weirs having a web between adjacent arc weirs and regular spacing upon the circumference of the interior of said spout.

6. The nozzle of claim 5 wherein one gap is collocated with a notch upon said bushing.

7. The nozzle of claim 6 further comprising:

said fins extending lengthwise in and along said spout for one half or more diameters of said spout, incising into said interior surface of said spout and extending towards the center of said spout, and having the same inner diameter as the interior surface of said spout without a surface treatment;

said tip restrictor locating within the length of said vent tube generally centered within the length of said fins; and, said bushing secured to the distal end of said spout;

whereby upon shutoff of said nozzle, residual fuel remains behind said arc weirs, within said fins, and ahead of said tip restrictor.

8. A method to impede fuel within a nozzle following shutoff preventing formation of drips, said nozzle having a spout, a bushing at the distal end of said spout, and a vent tube within said spout, the steps comprising:

applying a texture to the interior surface of said spout, wherein capillary action and hydraulic damming retains fuel drops within said spout;

providing three equally spaced arc weirs extending into a bushing wherein hydraulic damming retains fuel within said bushing; and, installing a vapor restrictor within said vent tube therein reducing the fuel in said vent tube.

9. The method of claim 8 wherein said texture is a plurality of fins, concentric, with the plane of said fins parallel to the diameter of said spout, and extending less than five per cent of the diameter towards the center of said spout.

10. A nozzle for dispensing fuel into a vehicle tank has a spout; a bushing at the distal end of said spout said bushing having a generally cylindrical shape with a front having a lip, a step of lesser diameter than said lip, a rear of similar diameter to said front, and a hollow center there through; and, a cylindrical vent tube within said spout, wherein the improvement comprises:

said spout having a plurality of fins being concentric and upon the circumference of the interior of said spout, said plurality located upon a portion of the length said spout, to retain fuel drops within said nozzle.

11. The nozzle of claim 10 further comprising:

said plurality of fins extending lengthwise in and along said spout for one half or more diameters of said spout, said fins incising into the interior surface of said spout and extending towards the center of said spout, and having the same inner diameter as the interior surface of said spout without said fins.

12. A nozzle for dispensing fuel into a vehicle tank has a spout; a bushing at the distal end of said spout said bushing having a generally cylindrical shape with a front having a lip, a step of lesser diameter than said lip, a rear of similar diameter to said front, and a hollow center there through; and, a cylindrical vent tube within said spout, wherein the improvement comprises:

said bushing having one or more arc weirs upon the interior of said bushing and extending into said bushing, to retain fuel within said nozzle.

13. The nozzle of claim 12 further comprising:

a plurality of said arc weirs extending into said bushing less than ten per cent of the outside diameter of said bushing, having a web between adjacent arc weirs and regular spacing upon the circumference of the interior of said spout, including one gap collocated with a notch upon said bushing.

* * * * *